US011505946B2

(12) United States Patent
Woo

(10) Patent No.: US 11,505,946 B2
(45) Date of Patent: Nov. 22, 2022

(54) CONSTRUCTION ELEMENTS

(71) Applicant: Donald Kew Woo, Spring Creek, NV (US)

(72) Inventor: Donald Kew Woo, Spring Creek, NV (US)

( * ) Notice: Subject to any disclaimer, the term of this patent is extended or adjusted under 35 U.S.C. 154(b) by 0 days.

(21) Appl. No.: 17/067,410

(22) Filed: Oct. 9, 2020

(65) Prior Publication Data

US 2021/0025173 A1 Jan. 28, 2021

Related U.S. Application Data

(63) Continuation of application No. 16/100,395, filed on Aug. 10, 2018, now Pat. No. 10,801,212.

(60) Provisional application No. 62/571,673, filed on Oct. 12, 2017.

(51) Int. Cl.

| | |
|---|---|
| ***E04F 13/06*** | (2006.01) |
| ***E04F 19/02*** | (2006.01) |
| ***E04B 2/74*** | (2006.01) |

(52) U.S. Cl.

CPC ..... *E04F 13/06* (2013.01); *E04B 2/7457* (2013.01); *E04F 19/022* (2013.01); *E04F 19/028* (2013.01); *E04F 2013/061* (2013.01); *E04F 2013/063* (2013.01)

(58) Field of Classification Search

CPC ..... E04F 13/06; E04F 2013/061; E04F 2013/063; E04F 19/022; E04F 19/028; E04B 2/7457

USPC ..... 52/282.1

See application file for complete search history.

(56) References Cited

U.S. PATENT DOCUMENTS

| | | | |
|---|---|---|---|
| 290,750 | A | 12/1883 | Da Cunha |
| 916,378 | A | 3/1909 | Sunderland |
| 1,642,282 | A | 9/1927 | Weiss |
| 1,657,332 | A | 1/1928 | Absmeier |
| 1,674,439 | A | 6/1928 | Knapp |
| 1,678,813 | A | 7/1928 | Jones |

(Continued)

FOREIGN PATENT DOCUMENTS

| | | | |
|---|---|---|---|
| CA | 2330125 | A1 | 11/1999 |
| EP | 2067905 | A2 | 6/2009 |

(Continued)

OTHER PUBLICATIONS

Jan. 17, 2019 International Search Report and Written Opinion issued in International Application No. PCT/US2018/055632.

(Continued)

*Primary Examiner* — Christine T Cajilig
(74) *Attorney, Agent, or Firm* — Oliff PLC

(57) ABSTRACT

A construction element is provided for forming a corner of a surface of a building, the surface including wall panels attached to framing studs. The construction element includes: a corner-forming surface that that is shaped to extend, in a cross-sectional view, between two separate wall panels, such that ends of the corner-forming surface, as viewed in the cross-sectional view, substantially match respective corners of the wall panels; and a fastener strip that, in a state in which the corner-forming surface is in its installed position with respect to the framing studs, is substantially parallel to one or more of the framing studs, such that a fastener can attach the fastener strip to one or more of the studs without passing through the wall panel.

7 Claims, 17 Drawing Sheets

(56) References Cited

U.S. PATENT DOCUMENTS

| | | | | |
|---|---|---|---|---|
| 1,841,670 | A | 1/1932 | Parker | |
| 3,440,790 | A | 4/1969 | Nerem | |
| 4,601,138 | A | 7/1986 | Hampton | |
| 5,664,376 | A | 9/1997 | Wilson et al. | |
| 5,671,583 | A | 9/1997 | Turner | |
| 5,839,250 | A | 11/1998 | Hibler | |
| 6,088,987 | A * | 7/2000 | Simmons | E04B 2/14 52/592.4 |
| 6,176,637 | B1 | 1/2001 | Hatlan et al. | |
| 6,481,170 | B1 | 11/2002 | Savenok et al. | |
| 6,553,732 | B2 | 4/2003 | Shaw | |
| 8,061,105 | B2 | 11/2011 | Haga | |
| 8,756,886 | B1 | 6/2014 | Grant | |
| 8,863,457 | B2 | 10/2014 | Rottiers et al. | |
| 9,482,010 | B2 | 11/2016 | Kartler | |
| 2003/0226327 | A1 | 12/2003 | Perry | |
| 2004/0060252 | A1 | 4/2004 | Daly | |
| 2005/0257461 | A1 | 11/2005 | Daly | |
| 2006/0117685 | A1 | 6/2006 | Kenessey | |
| 2007/0094996 | A1 | 5/2007 | Young | |
| 2008/0041000 | A1 | 2/2008 | Hensch | |
| 2010/0192494 | A1 | 8/2010 | Baccarini | |
| 2012/0240505 | A1 | 9/2012 | Moscovitch | |

FOREIGN PATENT DOCUMENTS

| | | | | |
|---|---|---|---|---|
| GB | 568852 | A * | 4/1945 | E04F 19/022 |
| JP | 2003097010 | A | 4/2003 | |
| JP | 2015038297 | A | 2/2015 | |

OTHER PUBLICATIONS

Feb. 25, 2020 Office Action Issued in U.S. Appl. No. 16/100,395.

Apr. 23, 2020 IPRP with Written Opinion issued in International Application No. PCT/US2018/055632.

Jun. 12, 2020 Notice of Allowance Issued in U.S. Appl. No. 16/100,395.

Jul. 31, 2019 Office Action Issued in U.S. Appl. No. 16/100,395.

* cited by examiner

CONSTRUCTION ELEMENTS

This application claims the priority benefit of provisional application No. 62/571,673 filed Oct. 12, 2017, and of U.S. non-provisional patent application Ser. No. 16/100,395, filed Aug. 9, 2018, the disclosures of which are incorporated herein by reference in their entirety.

BACKGROUND (Alt+F1 for Bracketed Num) (Alt+F2 to Update All if you Delete or reorder Paragraphs) This disclosure relates generally to construction elements for residential and commercial buildings and, more specifically, elements and methods for creating rounded corners with a greater radius to provide softer, flowing corners within a constructed building, as compared with square corners or rounded corners with a small radius such as 1.5 inches or less. The construction element may be used both vertically and horizontally in any space that requires a corner or where a bend or curve is desired in a wall, ceiling, or the like (hereinafter collectively referred to as "wall").

In all constructed buildings there are places within the building where at least two walls intersect. When the walls intersect it is necessary to put a corner on those walls to hide the exposed place where often two pieces of drywall come together on a wood or metal stud, or other type of vertical brace (hereinafter referred to as "stud"). In many instances a rounded bead or square bead is utilized to lie over or across the two pieces of dry wall to create a smooth corner. A smooth corner may be rounded or it may be sharp but is intended to cover the edge of two edges of dry wall where multiple walls intersect.

In some construction buildings there are bends in a wall, or curves in a wall that are gradual and rounded and the wall bends around a corner having a relatively large radius, such as 2" or more. These elongated bends may be substantially different than the straight walls that simply form a straight plane. The elongated curved walls are often constructed with wood or metal studs to form the desired curvature of the wall. Multiple studs may be required to manipulate to the desired curvature. Drywall is then also required to be bent at the proper curvature as well to be fastened to the studs. Often the wood studs and/or the drywall must be water treated, so as not to break and so the proper curvature can be made to the desired curvature of the wall.

Current construction elements would make it difficult, if not impossible to create sharper bends around a corner of two walls intersecting but less sharp than a long curvature of an entire length of a wall. Specifically within residential construction, creating a large-radius bend or curve around a corner becomes very difficult given the current products typically available for construction.

SUMMARY

The disclosure relates to construction elements and methods for making bends and curves in constructed walls and at wall intersections. The construction elements allow for a simple "drop in place" solution for creating aesthetically pleasing walls with large-radius curves in the design of the constructed building. The construction elements may be utilized to provide bends and curves in walls without needing to wet and bend drywall and/or wooden studs.

BRIEF DESCRIPTION OF THE DRAWINGS

Exemplary embodiments will be described below with reference to the drawings, wherein like numerals represent like parts, and wherein.

DETAILED DESCRIPTION OF EMBODIMENTS

In various embodiments described below, a construction element is provided for forming a corner of an interior surface of a building, the interior surface including wall panels attached to framing studs. The construction element may include: a corner-forming surface that is shaped to extend, in a cross-sectional view, between two separate wall panels, such that ends of the corner-forming surface, as viewed in the cross-sectional view, substantially match respective corners of the wall panels; and a fastener strip that, in a state in which the corner-forming surface is in its installed position with respect to the framing studs, is substantially parallel to one or more of the framing studs, such that a fastener can attach the fastener strip to one or more of the studs without passing through the wall panel.

Figure 1:
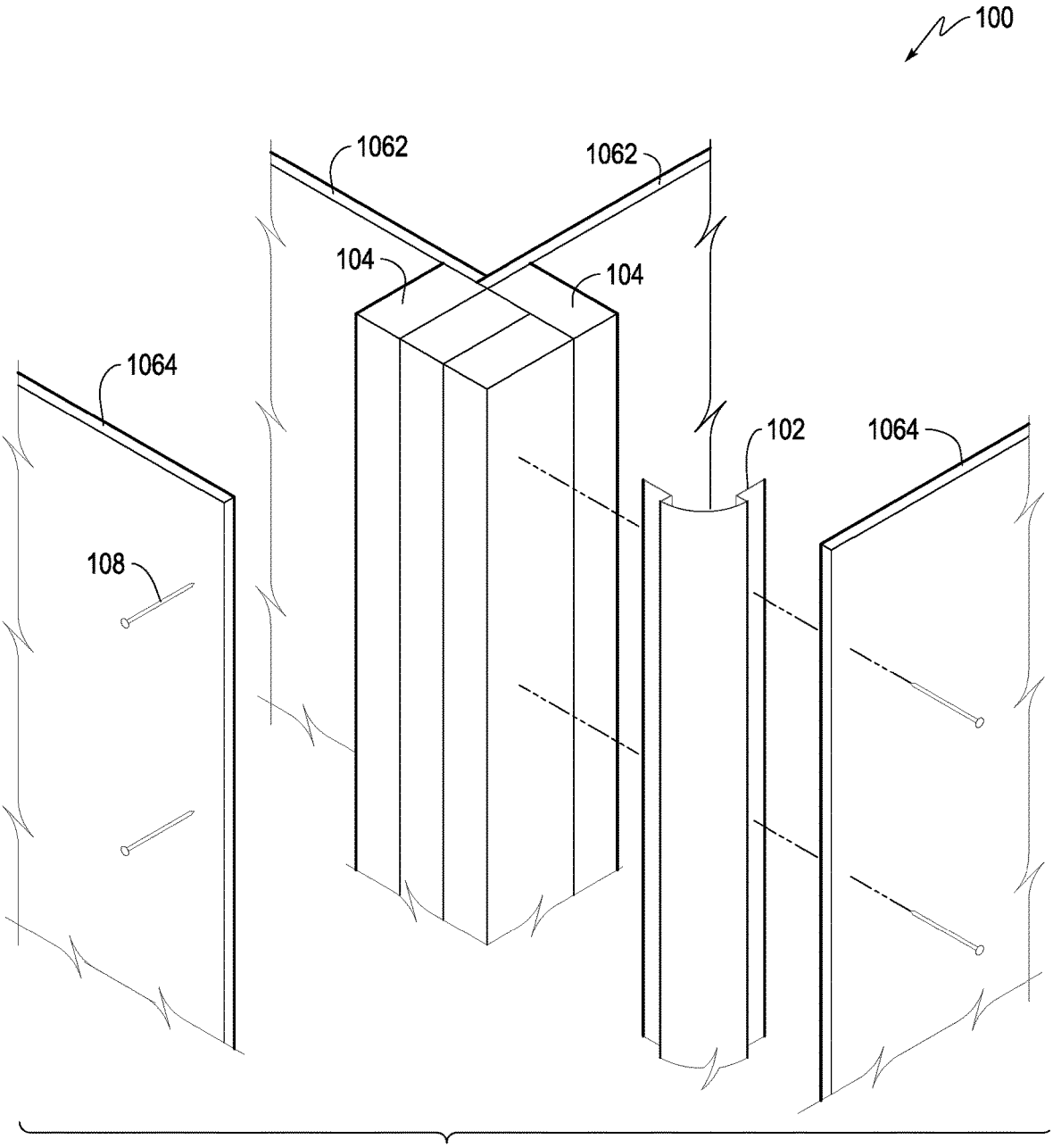
FIG. 1 is a blown-apart view of wall structure including a corner construction element.

FIG. 1 is a blown-apart view of wall structure 100 including a corner construction element 102. The wall structure 100 includes studs 104, which may be standard 2×4 or 2×6 wood or metal studs commonly used in the construction industry, for example, according to known framing techniques. Interior wall panels 1062 are attached to an inside corner formed by the studs 104, and exterior wall panels 1064 are attached to an outside corner formed by the studs 104. "Exterior" and "outside" in this context include surfaces that are inside a building structure, and do not necessarily refer to an exterior wall of a building structure. Thus, the wall structure 100 may be the structure of an interior wall of a building, which may or may not be a load-bearing wall (i.e., a wall that bears the weight of structural elements above it).

The walls panels 1062 and 1064 may be commonly used drywall panels, sometimes called gypsum panels, such as SHEETROCK brand drywall panels. Other types of wall panels are also acceptable.

The corner construction element 102 attaches to an outside corner formed by the studs 104 as shown. Fasteners 108, which may be standard drywall nails or drywall screws, pass through a wall panel 1064, through a leg portion of the corner construction element 102 as described in more detail below, and into a stud 104. The corner construction element 102 may be pre-attached to the studs 104 by one or more fasteners 108 prior to installation of the wall panels 1064 to hold the corner construction element 102 in place while the wall panels 1064 are positioned and attached. That is, first, the corner construction element 102 may be positioned relative to the studs 104, then one or more fasteners 108 passed through one or both leg portions of the corner construction element 102, then the wall panels 1064 positioned relative to the corner construction element 102 and studs 104, then other fasteners 108 passed through respective ones of the wall panels 1064, through respective ones of the leg portions of the corner construction element 102, and into respective ones of the studs 104. Alternatively, if the corner construction element 102 can be held in place without pre-attaching it to the studs 104 as described above, the pre-attachment step can be omitted.

Figure 2:
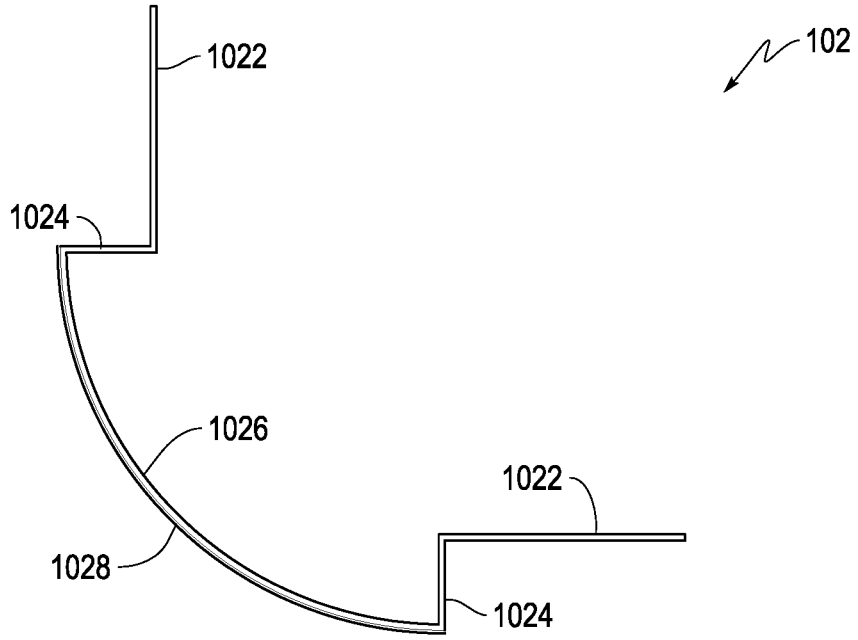
FIG. 2 is a plan view of a corner construction element.

FIG. 2 is a plan view of the corner construction element 102. The corner construction element 102 includes leg portions 1022 (fastener strips) and a curved portion 1026 (corner-forming surface). Step portions 1024 connect respective ones of the leg portions 1022 to the curved portion 1026. The width of the step portions 1024 is preferably equal to or slightly larger than the thickness of standard drywall sheets. Standard drywall sheets typically have a thickness of ½" or ⅝" for vertical walls, or ⅜" or ½" for ceilings. An advantage to having the width of the step portions 1024 be slightly larger than the thickness of the wall panels 1064 to be used is that when drywall tape and drywall compound (also known as "drywall mud") are applied over the seam between the corner construction element 102 and the wall panels 1064, there is a depression formed at the seam to accommodate the tape and compound. For example, the step portions 1024 may be in a range of about 1/16" to about ⅛" larger than the thickness of the wall panels 1064 to be used.

A facing layer 1028 may be applied along the outer curvature of the curved portion 1026, and may be attached to the curved portion 1026 by adhesive, for example. The facing layer 1028 may be of heavy paper material, for example, or of fiberglass or thin plastic material such as vinyl or PVC, or of a composite of two or more of these materials or other materials. In some embodiments, the facing layer 1028 may be applied as a spray-on layer that hardens to a desired texture. An advantage of the facing layer 1028 is that the outer layer of the corner construction element 102 may be similar or identical to the outer layer of the wall panels 1064 in terms of characteristics such as texture, absorption or the like, making it easier to create a uniform appearance around the outer corner of the wall structure 100 when priming, painting or the like. However, in some embodiments, the facing layer 2018 may be omitted, and the outer corner of the wall structure 100 may be finished by applying primer, paint or other coating material directly to the material of the curved portion 1026.

The corner construction element 102 may be made of a thin, somewhat rigid material, such as metal, fiberglass, or plastic material such as vinyl or PVC, or of a composite of two or more of these materials or other materials. It may be bent into its final shape from a flat piece of material, or extruded into the desired shape.

Figure 3:
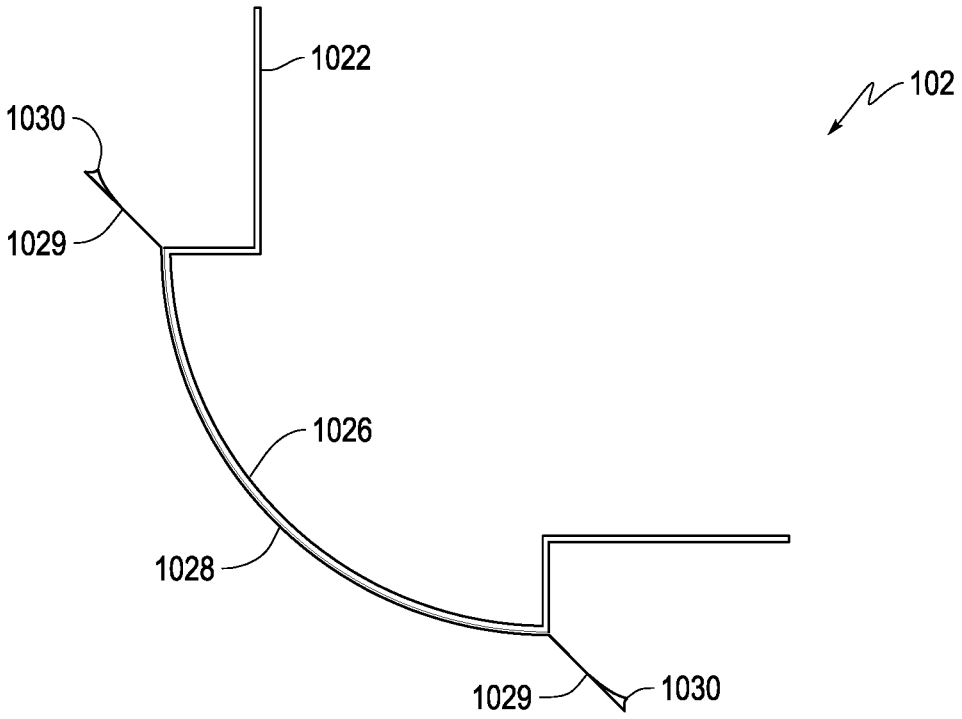
FIG. 3 is a plan view of a corner construction element.

FIG. 3 is a plan view of a corner construction element 102 that is the same as that described in connection with FIG. 2, except that the corner construction element 102 of FIG. 3 additionally has wing portions 1029 extending from ends of the curved portion 1026. The flexible wing portions 1029 may be an extension of the material of the facing layer 1028. Alternatively, the wing portions 1029 may be a separate layer, of material the same as or different from that of the facing layer 1028, such as paper material, fiberglass, or plastic material such as vinyl or PVC, or of a composite of two or more of these materials or other materials, attached to the curved portion 1026 or to the step portions 1024. When attached as a separate layer to the curved portion 1026, the wing portions 1029 may be attached to the outer surface of the facing layer 1028 by adhesive, for example, or may be sandwiched between the curved portion 1026 and the facing layer 1028. In some embodiments, the curved portion 1026, the wing portions 1029, the step portions 1024 and the leg portions 1022 may be formed of the same material. For example, these portions may all be formed of plastic material, such as vinyl or PVC, and formed together as one piece by extrusion or another forming method.

The wing portions 1029 may have an adhesive layer, covered by a release layer 1030 that may be peeled off to expose the adhesive layer, so that the wing portions 1029 may be adhered to the wall panels 1064 as described hereafter. Alternatively, instead of using an adhesive layer, the wing portions 1029 may be attached to the wall panels 1064 using a thin layer of drywall compound, according to known techniques.

Figure 4:
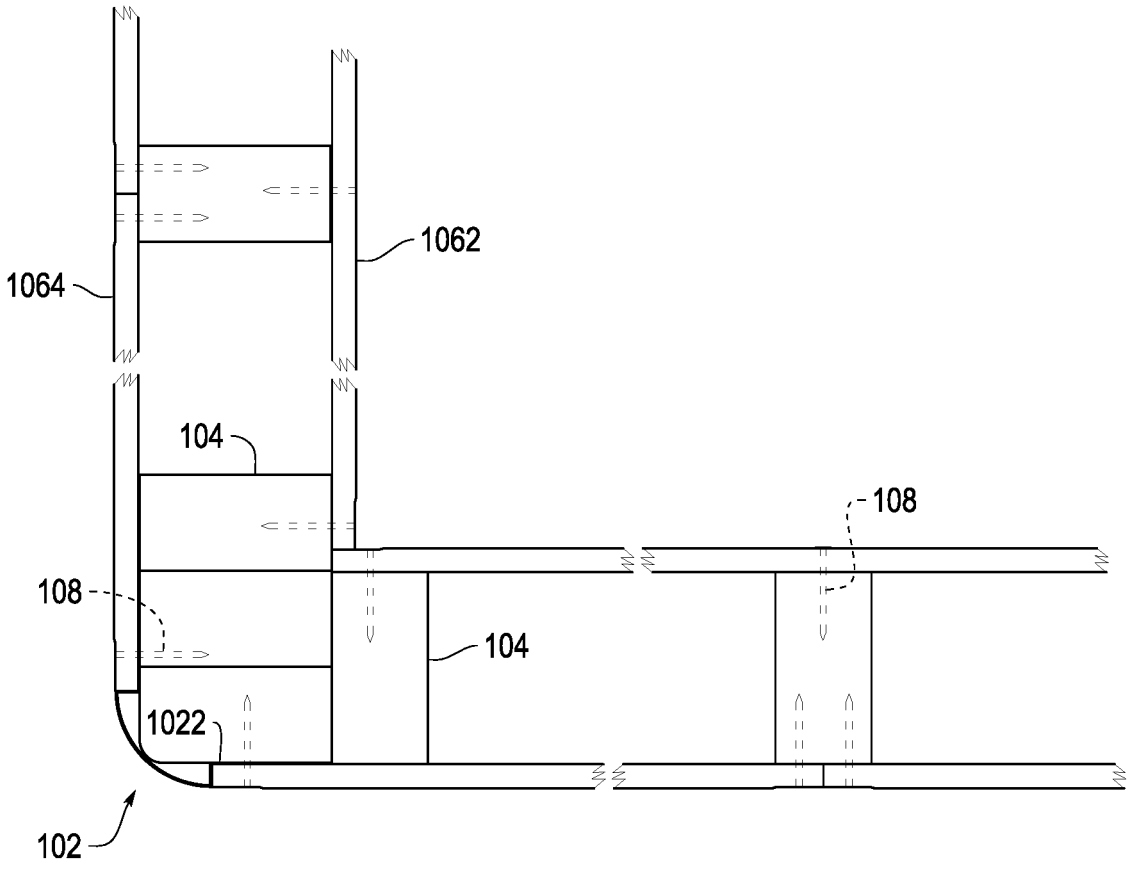
FIG. 4 is a plan view of an assembled wall structure including a corner construction element.

FIG. 4 is a plan view of an assembled wall structure including a corner construction element 102. The corner construction element 102 may have a radius up to about 4 inches, and preferably at least 2 inches, such as any radius from 2 to 4 inches in increments of ⅛". The inside curved surface of the corner construction element 102 may be in contact with the corner stud 104 as shown, for greater rigidity of the finished corner of the wall structure. The corner stud 104 is shown having a rounded corner to reflect the fact that most 2×4 wood studs have slightly rounded edges (although the depiction of the rounded edge may be somewhat exaggerated in this drawing), and the corner construction element 102 may contact the rounded edge instead of the corner of a theoretically perfectly rectangular-cross-section stud. Metal studs may be closer to perfectly rectangular in cross section, and for metal stud applications a corner construction element 102 may be used that has a slightly smaller radius of curvature to better fit against the corner of a metal corner stud 104.

As depicted in FIG. 4, and as described above, fasteners 108 pass through the exterior wall panels 1064, through the leg portions 1022, and into the studs 104. The interior wall panels 1062 are attached directly to the studs 104 by additional fasteners 108. Additional studs 104 may be spaced along the intersecting wall sections as depicted, and may have a center-to-center spacing of 16" or 24", for example, according to common framing techniques. The four studs 104 forming the corner of the frame may be attached together using framing nails (not shown) or other suitable fasteners.

The wall panels 1062 and 1064 may have tapered edges, as in common in drywall panels, to form a recess for accommodating drywall tape and drywall compound to facilitate the drywall finishing process. As described above, the width of the step portions 1024 of the corner construction element 102 may be slightly larger than the thickness of the wall panels 1064. If desired, different corner construction elements 102 with different widths of the step portions 1024 may be provided, depending on whether wall panels 1064 with tapered edges or untapered edges are to be used.

Figure 5:
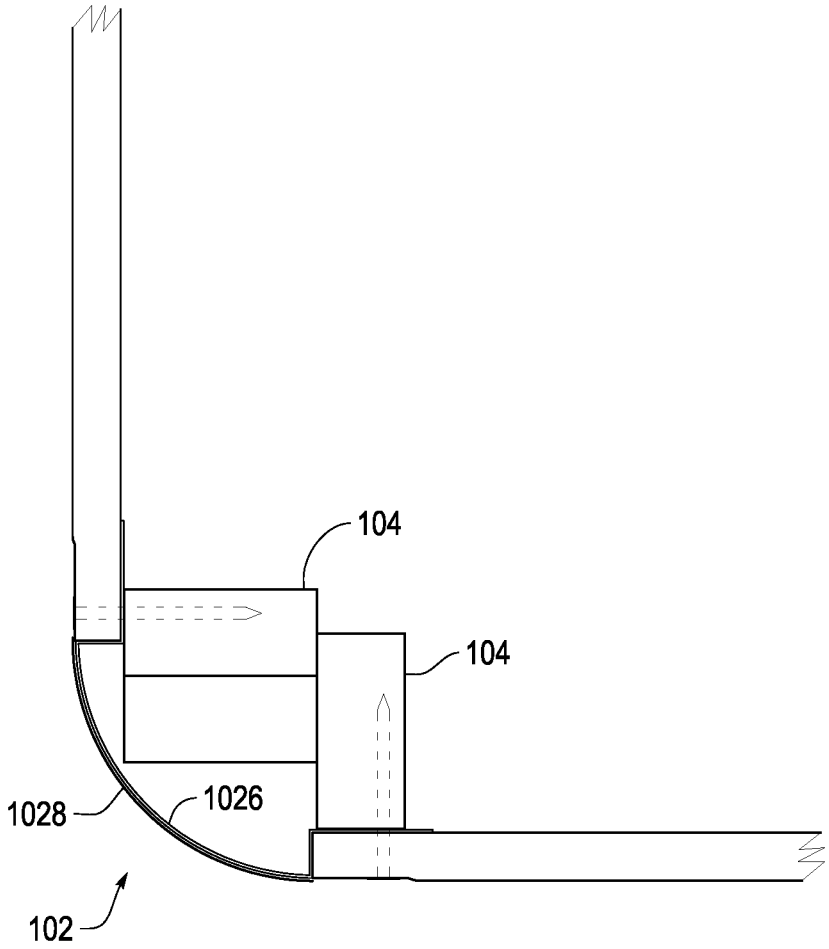
FIG. 5 a plan view of a partially assembled wall structure including a corner construction element.

FIG. 5 is a plan view of a partially assembled wall structure including a corner construction element 102. In this structure, a slightly different framing technique is used, in which three studs 104 are used to form the corner of the frame, and one stud 104 is offset with respect to the other two. In this construction, the radius of the curved portion 1026 of the corner construction element 102 may be larger than in the structure shown in FIG. 4. For example, the radius of the curved portion 1026 of the corner construction element 102 may be up to about 6 inches, and preferably at least 2 inches, such as any radius from 2 to 6 inches in increments of ⅛ ". Although not depicted, interior wall panels 1062 may be attached directly to the studs 104 at the inside corner as in FIG. 4.

Figure 6:
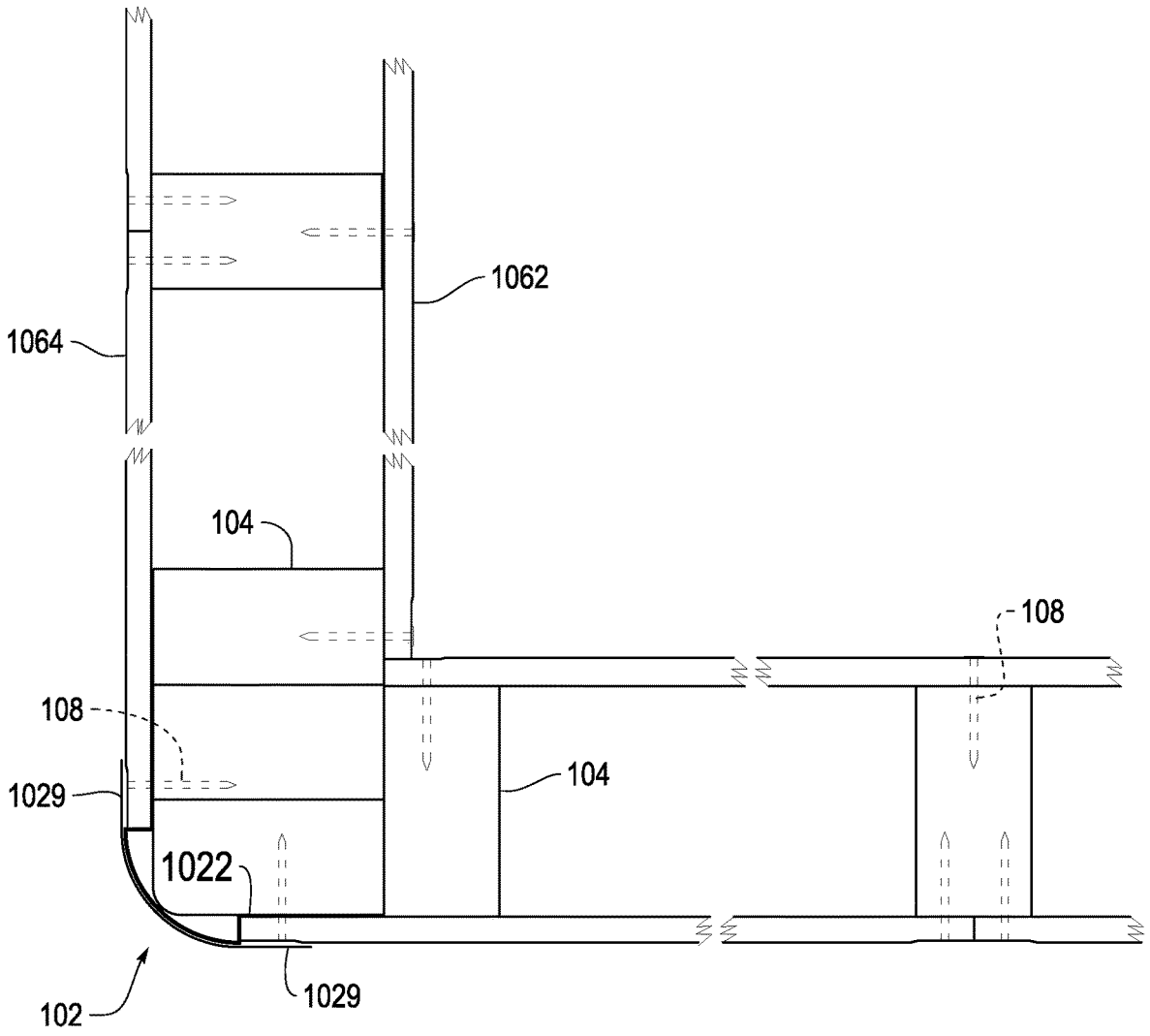
FIG. 6 is a plan view of an assembled wall structure including a corner construction element.

FIG. 6 is a plan view of an assembled wall structure including a corner construction element 102. The structure of FIG. 6 is the same as that of FIG. 4, except that the corner construction element 102 includes wing portions 1029 as shown in FIG. 3. The wing portions 1029 have been attached to the wall panels 1064 after installation of the wall panels 1064, thereby covering the seam between the wall panels 1064 and the corner construction element 102.

Figure 7:
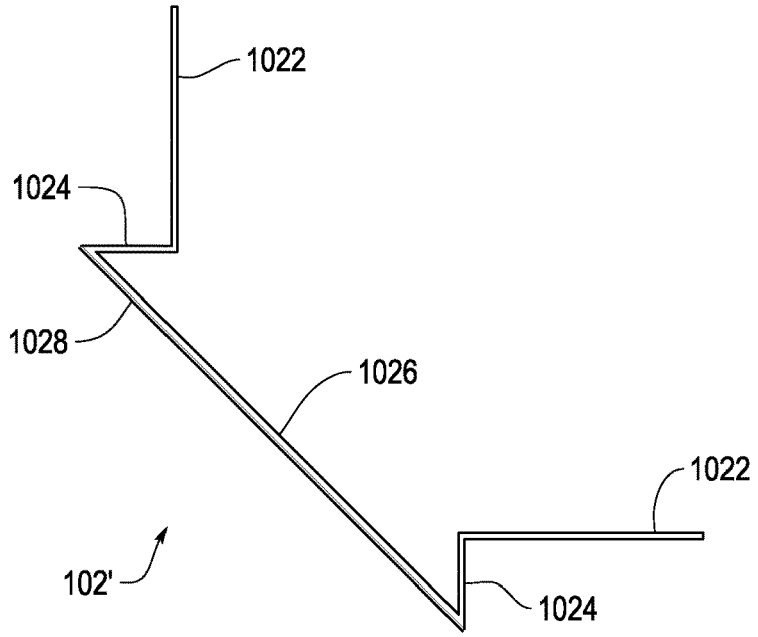
FIG. 7 is a plan view of a corner construction element.

FIG. 7 is a plan view of a corner construction element 102'. Instead of a curved portion 1026, the corner-forming surface 1026 connecting the step portions 1024 is straight instead of curved. It will be appreciated that an alternate framing technique, such as the one depicted in FIG. 5, will be needed in the case of the corner construction element 102'.

Although the corner construction elements shown in FIGS. 1-7 are designed for corners of walls that intersect each other substantially at 90°, corner construction elements may be made for corners of walls that intersect each other at other angles, such as 30°, 45° or 60°.

Figure 8:
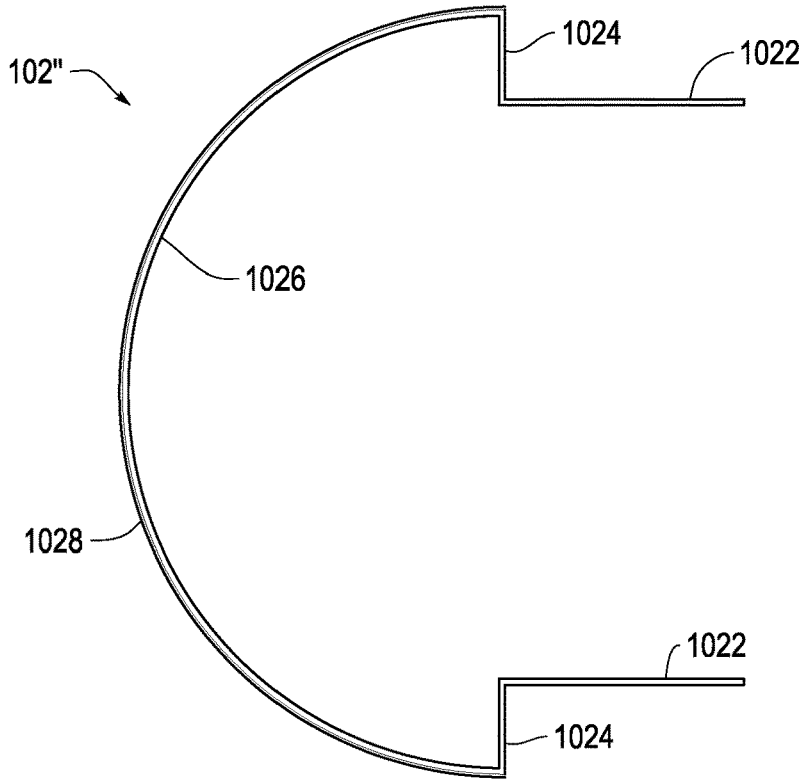
FIG. 8 is a plan view of an end cap construction element.

FIG. 8 is a plan view of an end cap construction element 102". The end cap construction element 102" has leg portions 1022 that are substantially parallel to each other, instead of being substantially perpendicular to each other as in the corner construction elements 102 shown in FIGS. 1-6. The curved portion 1026 of the end cap construction element 102" extends in a substantially semicircular or elliptic shape and connects the step portions 1024, and the facing layer 1028 extends along the entirety of the curved portion 1026.

Figure 9:
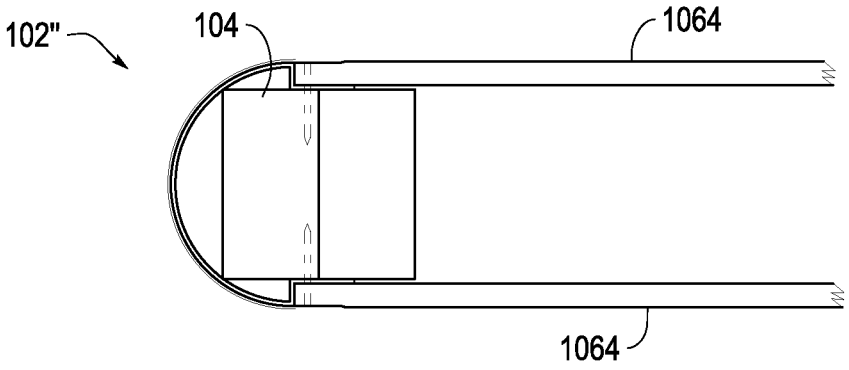
FIG. 9 is a plan view of an assembled wall structure including an end cap construction element.

FIG. 9 is a plan view of an assembled wall structure including the end cap construction element 102". The wall structure may be the structure of a partition wall that ends in a free space, instead of joining at its end to another wall section, or may be the side of of a doorway or window opening. The inside curved surface of the end cap construction element 102" may be in contact with the end stud 104 as shown, for greater rigidity of the finished end cap of the wall structure.

Figure 10:
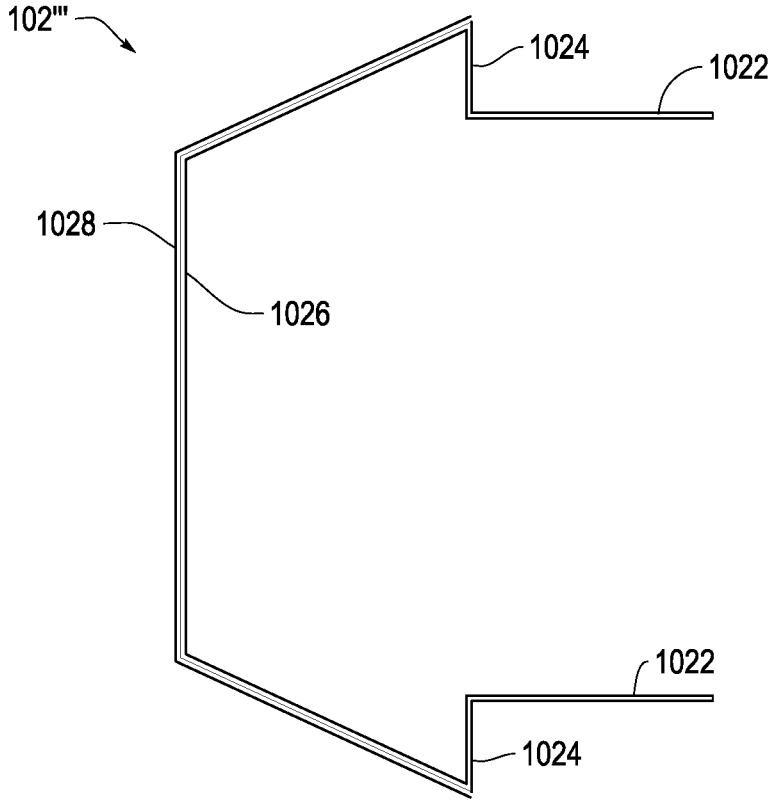
FIG. 10 is a plan view of an end cap construction element.

FIG. 10 is a plan view of an end cap construction element 102". The end cap construction element 102'" has leg portions 1022 that are substantially parallel to each other, as with the element 102" shown in FIGS. 8-9. The portion 1026 of the end cap construction element 102'" extends in a substantially trapezoidal shape or other polygonal shape and connects the step portions 1024, and the facing layer 1028 extends along the entirety of the portion 1026. The end cap construction element 102" may be incorporated in a wall structure that is otherwise similar to that shown in FIG. 9.

Figure 11:
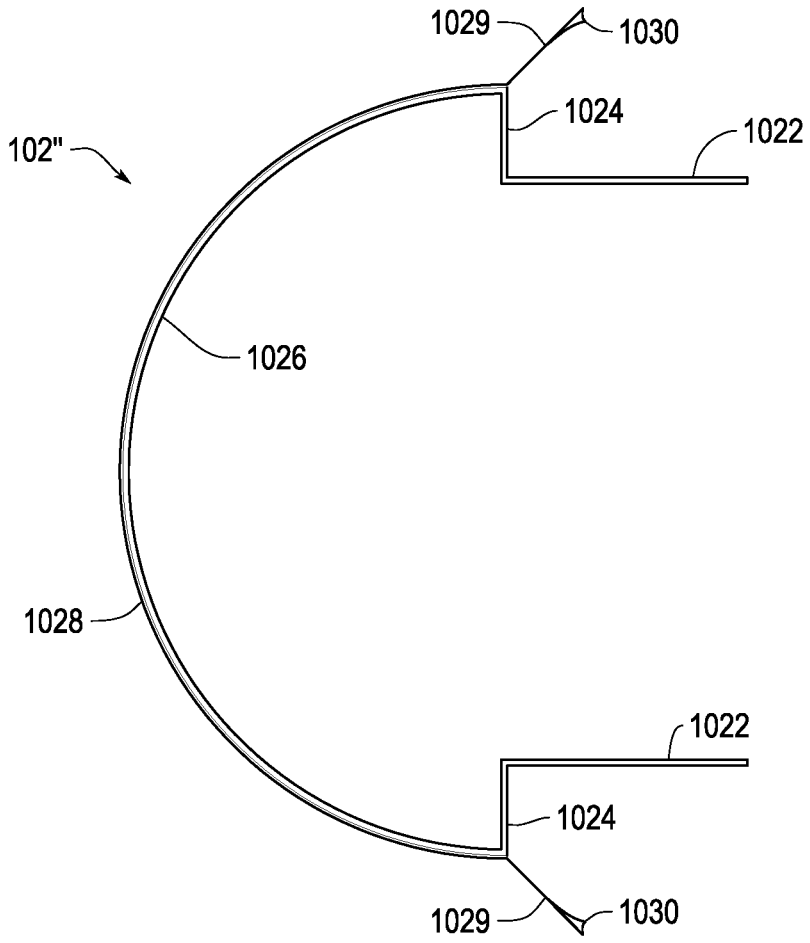
FIG. 11 is a plan view of an end cap construction element.

FIG. 11 is a plan view of an end cap construction element 102" that is the same as that shown in FIG. 8, except that that the end cap construction element 102 includes wing portions 1029 as shown in FIG. 3. The end cap construction element 102" may be incorporated in a wall structure that is otherwise similar to that shown in FIG. 9, and the wing portions 1029 may be attached to the wall panels 1064 after installation of the wall panels 1064, thereby covering the seam between the wall panels 1064 and end cap construction element 102".

Figure 12:
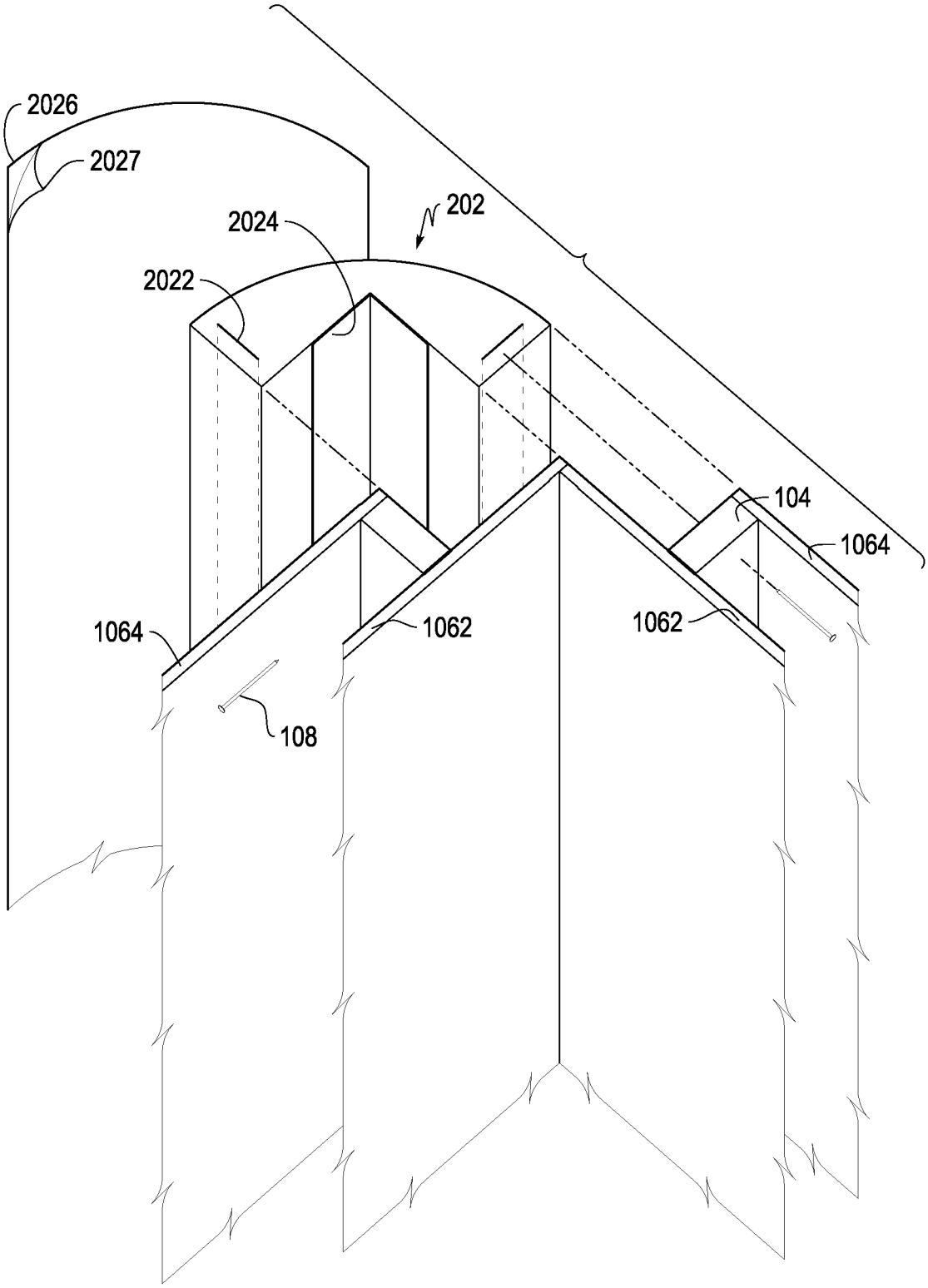
FIG. 12 is a blown-apart view of wall structure including a corner construction element.

FIG. 12 is a blown-apart view of wall structure including a corner construction element 202. The corner construction element 202 has fastener-engaging elements 2022 (fastener strips), and also a fastener-engaging element 2024. Fasteners 108 pass first through respective ones of wall studs 104 and then into respective ones of the fastener-engaging elements 2022. Wall panels 1062 and 1064 may be attached to the studs 104 as shown using fasteners 108, and the wall panels 1062 may be attached to the fastener-engaging element 2024 using additional fasteners 108 (which may be of a different length, such as a shorter length, than the fasteners that attach the wall studs to the corner construction element 202).

A facing layer 2026 may be applied along the outer curvature (corner-forming surface, which is not separately labeled in this embodiment) of the corner construction element 202, and may be attached to the corner construction element 202 by adhesive, for example. The facing layer 2026 may be of heavy paper material, for example, or may be a spray-on layer that hardens to a desired texture. The facing layer 2026 may have an adhesive layer, covered by a release layer 2027 that may be peeled off to expose the adhesive layer, so that the facing layer 2026 may be adhered to the corner construction element 202. Alternatively, the release layer 2027 may be omitted.

An advantage of the facing layer 2026 is that the outer layer of the corner construction element 202 may be similar or identical to the outer layer of the wall panels 1064 in terms of characteristics such as texture, absorption or the like, making it easier to create a uniform appearance around the outer corner of the wall structure when priming, painting or the like. However, in some embodiments, the facing layer 2026 may be omitted, and the outer corner of the wall structure may be finished by applying primer, paint or other coating material directly to the material of the corner construction element 202.

Figure 13:
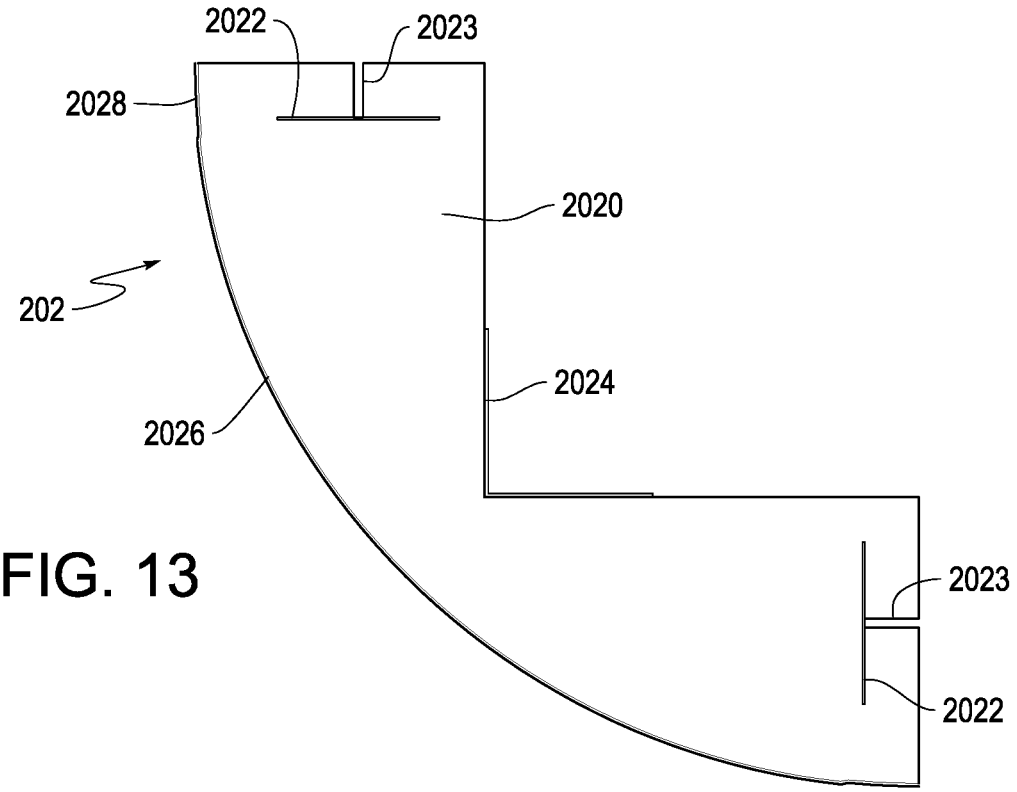
FIG. 13 is a plan view of a corner construction element.

FIG. 13 is a plan view of the corner construction element 202. The corner construction element 202 includes a body 2020 that may be formed of foam material, such as polystyrene foam material. The body 2020 is a solid body, meaning that it is not formed from a sheet of thin material that has been formed into a desired shape, and/or that the body 2020 occupies an entire space of a corner joint, such that no stud of one wall that is part of the corner connects directly to a stud of another wall that is part of the corner. (In contrast, for example, the construction elements 102 shown in FIGS. 1-6 are not "solid bodies" as that term is used in this disclosure.) The polystyrene foam material may be in the form of expanded polystyrene (also called "EPS") or extruded polystyrene (also called "XPS"). Another possible material for the body 2020 is a molded paper pulp material, such as the paper pulp material that some egg cartons are made of. Other materials are also possible, provided that they can hold the desired shape, The body 2020, when formed of foam material, may be cut from a larger block of foam material, by a known method such as hot wire cutting, or may be formed directly into its final shape during an extrusion forming process, for example.

In embodiments in which the body 2020 is made of foam material or another material than can be cut by a hot wire, spaces for the fastener-engaging elements 2022 can also be made by a hot wire. Spaces 2023 show paths through which a hot wire has passed before forming spaces for the respective fastener-engaging elements 2022. In other embodiments, foam or another material can be molded around the fastener-engaging elements 2022.

The fastener-engaging element 2024 may be attached to the body 2020 by an adhesive, for example. Additionally, although the fastener-engaging elements 2022 are shown and described above as passing through an interior of the body 2020, in other embodiments they may be attached to exterior faces of the body 2020 by an adhesive, for example, and not pass through the interior of the body 2020.

The fastener-engaging elements 2022 and 2024 may be made of metal or plastic material such as vinyl or PVC, for example, and may have a relatively small thickness, in a range of from about 0.2 mm to about 3 mm, for example, provided that they are sufficient to hold a fastener that has passed through them. In other embodiments, the fastener-engaging elements 2022 and 2024 may be made of other material sprayed on or attached by adhesive. Some embodiments may not include fastener-engaging elements 2022 and/or 2024, if the material of the body 2020 can adequately hold the fastener, or if the body 2020 is attached to the studs directly by an adhesive acting as a fastener, for example. The subsequent application of drywall tape and/or compound, particularly when wing portions are included as described below, further strengthens the connection between the corner construction element 202. Thus, particularly if the final wall assembly is not expected to be subjected to heavy pressure or jostling, for example, the fastener-engaging elements may be omitted.

At each end of the curved surface of the body 2020 there may be formed a recess 2028 to accommodate drywall tape and drywall compound that cover the seam between the corner construction element 202 and wall panels.

Figure 14:
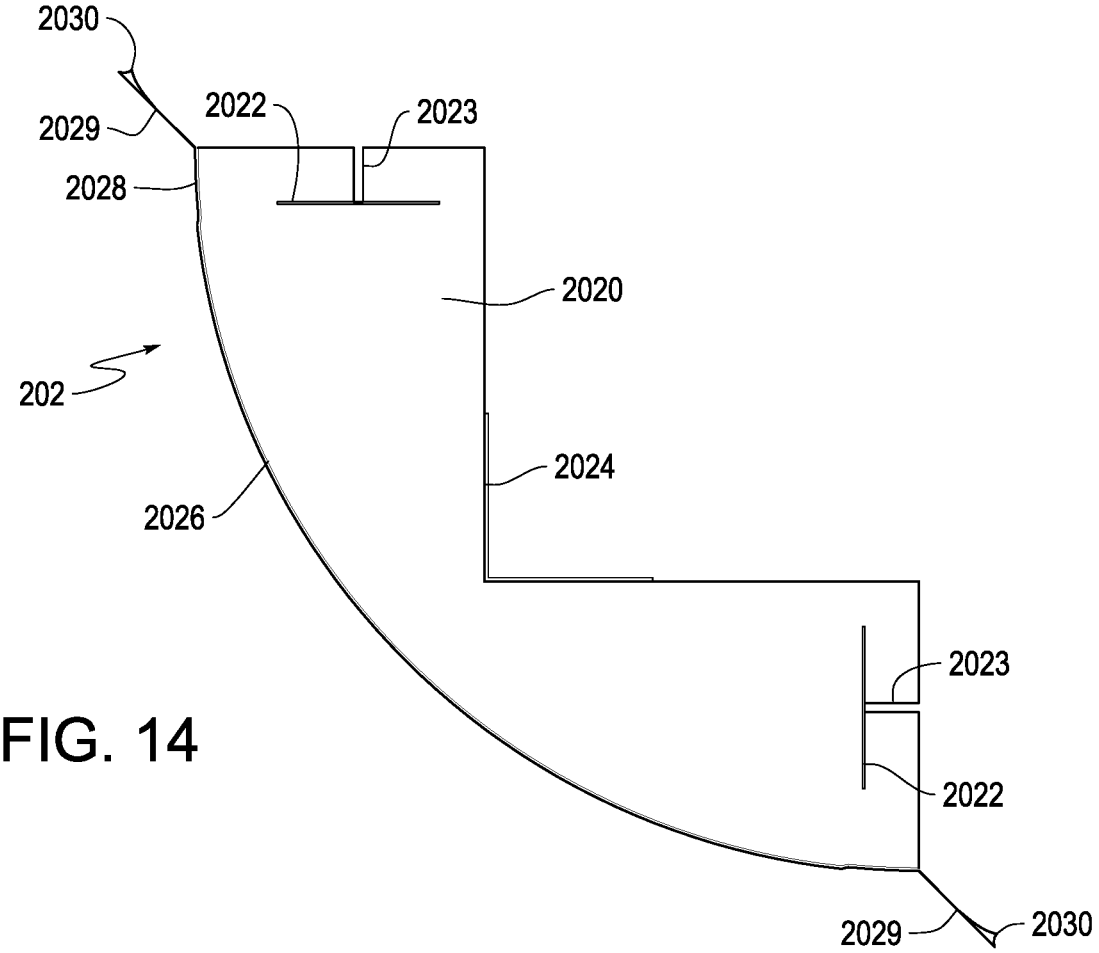
FIG. 14 is a plan view of a corner construction element.

FIG. 14 is a plan view of a corner construction element 202 that is the same as that described in connection with FIG. 13, except that the corner construction element 202 of FIG. 14 additionally has wing portions 2029 extending from ends of the curved surface of the body 2020. The flexible wing portions 2029 may be an extension of the material of the facing layer 2026. Alternatively, the wing portions 2029 may be a separate layer, of material the same as or different from that of the facing layer 2026, attached to the curved surface of the body 2020 or to the flat end surfaces of the body 2020. When attached as a separate layer to the curved surface of the body 2020, the wing portions 1029 may be attached to the outer surface of the facing layer 2026, or may be sandwiched between the body 2020 and the facing layer 2026.

The wing portions 2029 may have an adhesive layer, covered by a release layer 2030 that may be peeled off to expose the adhesive layer, so that the wing portions 2029 may be adhered to the wall panels 1064 as described hereafter. Alternatively, instead of using an adhesive layer, the wing portions 2029 may be attached to the wall panels 1064 using a thin layer of drywall compound, according to known techniques.

Figure 15:
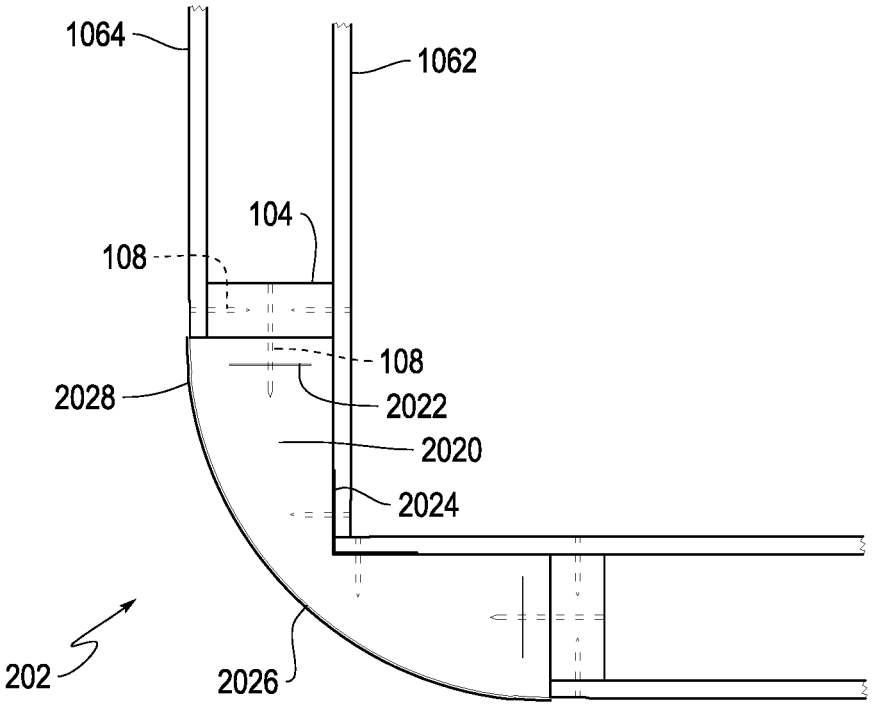
FIG. 15 is a plan view of an assembled wall structure including a corner construction element.

FIG. 15 is a plan view of an assembled wall structure including a corner construction element 202. The corner construction element 102 may have a radius of at least about 2 inches and up to about 16 inches, such as any radius from 2 to 16 inches in increments of ⅛", for 2×4 walls, or at least about 2 inches and up to about 30 inches, such as any radius from 2 to 30 inches in increments of ⅛", for 2×6 walls. 2×4 walls and 2×6 walls are mentioned here because they are common in the construction industry, but of course any other desired wall thickness is acceptable, in which case the radius of the corner construction element 102 would be adjusted appropriately. In each case, the radius of curvature is selected to be in a range such that the minimum thickness of the body 2020, which generally will be at the middle of the curved surface, is sufficient for the body 2020 not to easily break during handling and installation.

As depicted in FIG. 15, and as described above, fasteners 108 pass first through respective ones of wall studs 104 and then into respective ones of the fastener-engaging elements 2022. The fasteners 108 may be common nails, or, for a more secure holding effect, the fasteners 108 may be commonly known ring-shank nails and/or cement-coated nails, or screws, for example. In some embodiments, a strong adhesive can be used as a fastener.

Wall panels 1062 and 1064 may be attached to the studs 104 as shown using fasteners 108, and the wall panels 1062 may be attached to the fastener-engaging element 2024 using additional fasteners 108.

The wall panels 1062 and 1064 may have tapered edges, as is common in drywall panels, to form a recess for accommodating drywall tape and drywall compound to facilitate the drywall finishing process. Finishing of the outside corner (e.g., applying drywall tape and drywall compound to the seams between the corner construction element 202 and the wall panels 1064) is particularly facilitated when the tapered wall panel edges abut a corner construction element 202 that includes recesses 2028 as described above.

Figure 16:
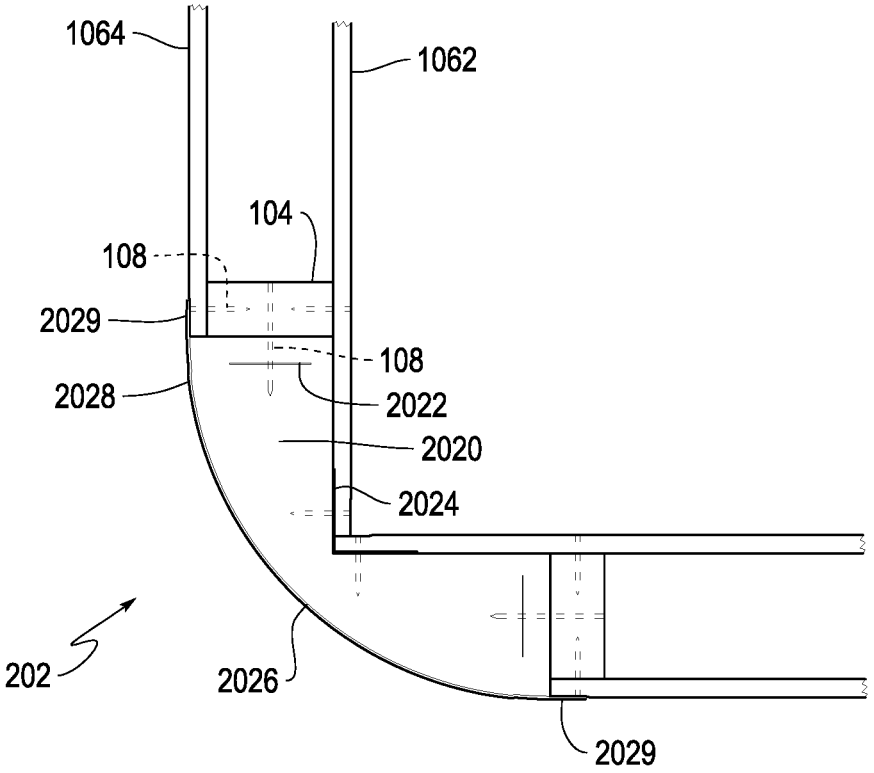
FIG. 16 is a plan view of an assembled wall structure including a corner construction element.

FIG. 16 is a plan view of an assembled wall structure including a corner construction element 202. The structure of FIG. 16 is the same as that of FIG. 15, except that the corner construction element 202 includes wing portions 2029 as shown in FIG. 14. The wing portions 1029 have been attached to the wall panels 1064 after installation of the wall panels 1064, thereby covering the seam between the wall panels 1064 and the corner construction element 202.

Figure 17:
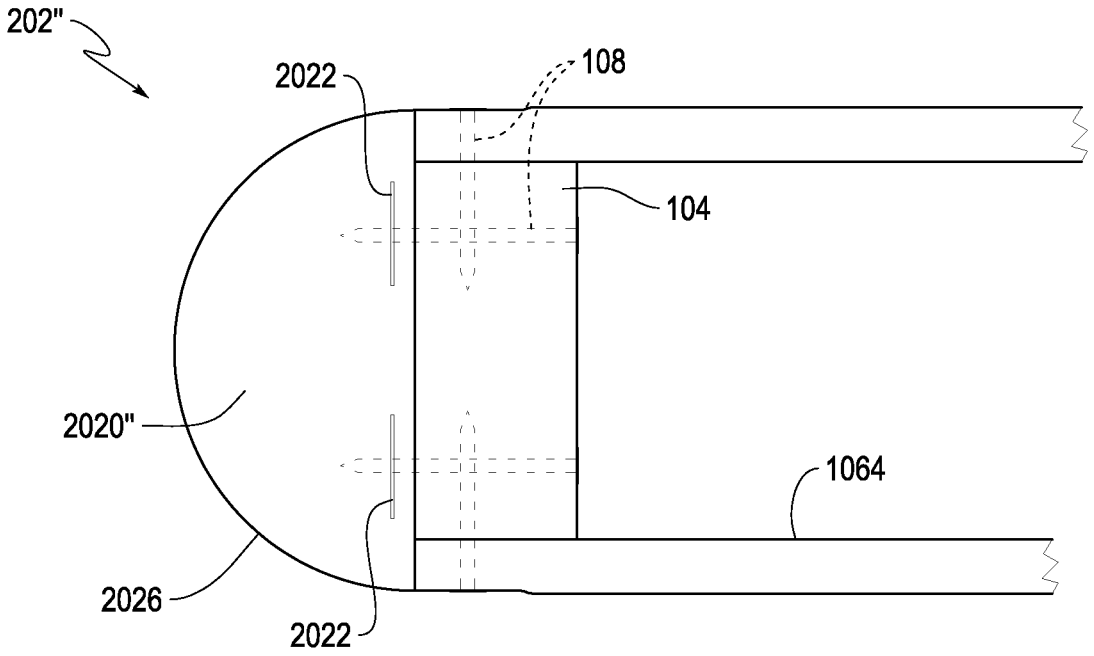
FIG. 17 is a plan view of an assembled wall structure including an end cap construction element.

FIG. 17 is a plan view of an assembled wall structure including an end cap construction element 202". The wall structure may be the structure of a partition wall that ends in a free space, instead of joining at its end to another wall section, or may be the side of a doorway or window opening. The end cap construction element 202" is similar to the corner constructions elements 202 described above, except that the body 2020" of the end cap construction element 202" has a curved surface that extends between edges of two wall panels 1064 that are substantially parallel to each other. The curved surface in this embodiment may be substantially semicircular, for example, or may be elliptic. Like the body 2020 of the corner constructions elements 202, the body 2020" may be formed of foam material, and may have a facing layer 2026.

Additionally, as shown, two fastener-engaging elements 2022 may be provided, although in some embodiments only a single fastener-engaging elements 2022, or more than two fastener-engaging elements 2022, may be provided.

Figure 18:
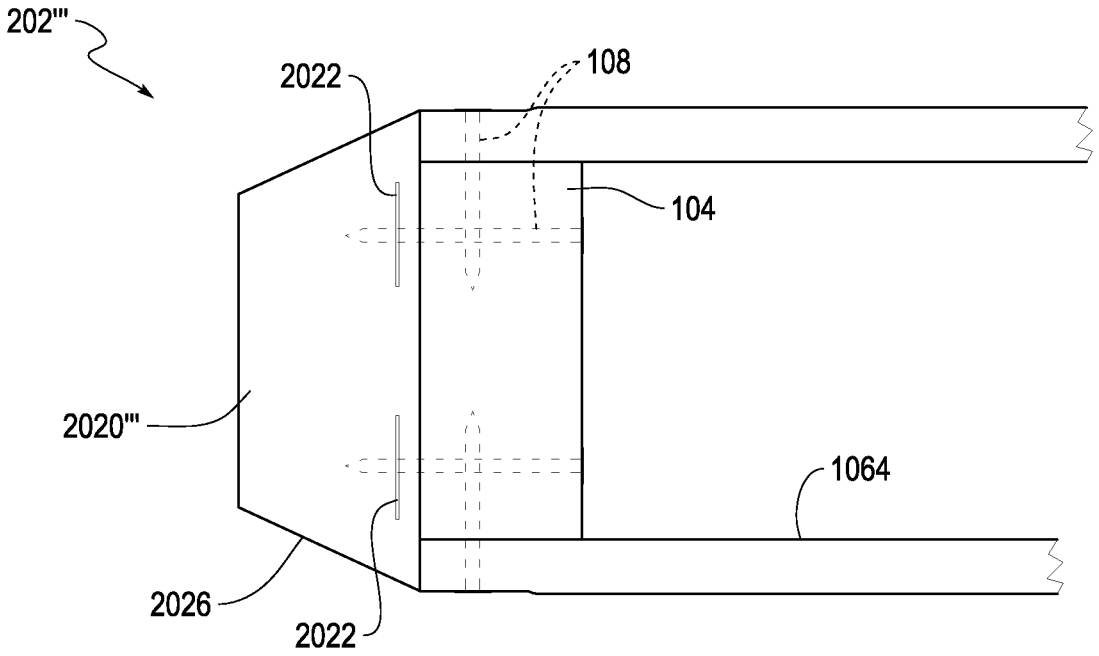
FIG. 18 is a plan view of an assembled wall structure including an end cap construction element.

FIG. 18 is a plan view of an assembled wall structure including an end cap construction element 202'''. The end cap construction element 202''' is similar to the end cap construction element 202'', except that the cross section of body 2020''' of the end cap construction element 202''' has a substantially trapezoidal shape or other polygonal shape.

Figure 19:
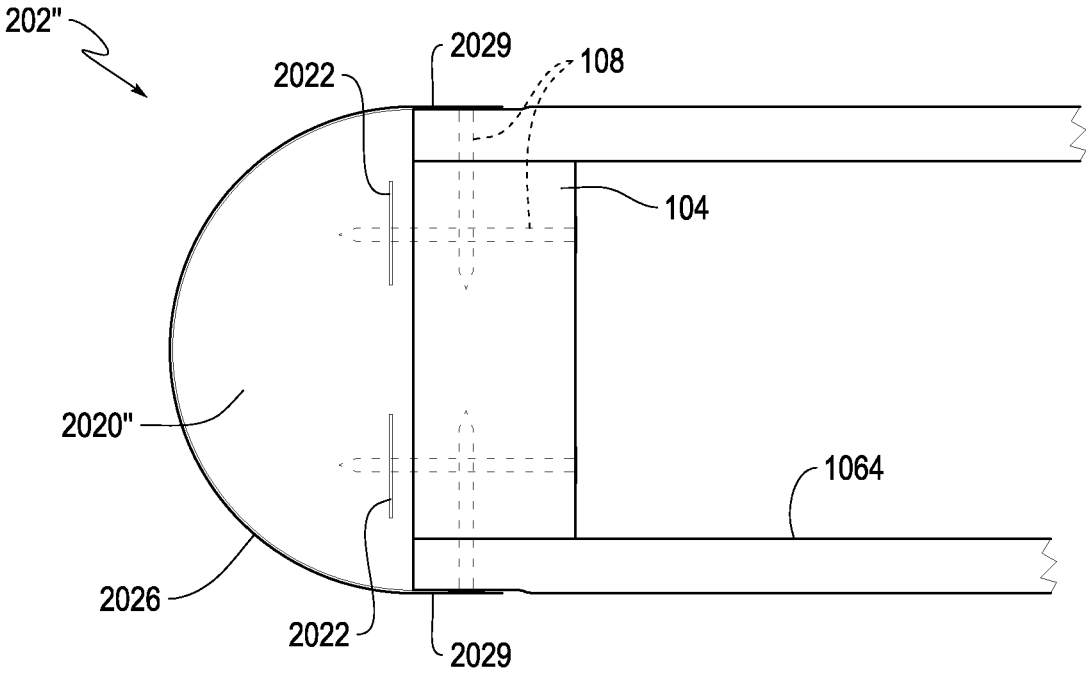
FIG. 19 is a plan view of an assembled wall structure including an end cap construction element.

FIG. 19 is a plan view of an assembled wall structure including an end cap construction element 202'' that has wing portions 2029. The structure of FIG. 19 is the same as that of FIG. 17, except that the end cap construction element 202'' includes wing portions 2029, like those described above. The wing portions 2029 have been attached to the wall panels 1064 after installation of the wall panels 1064, thereby covering the seam between the wall panels 1064 and the end cap construction element 202''.

Figure 20:
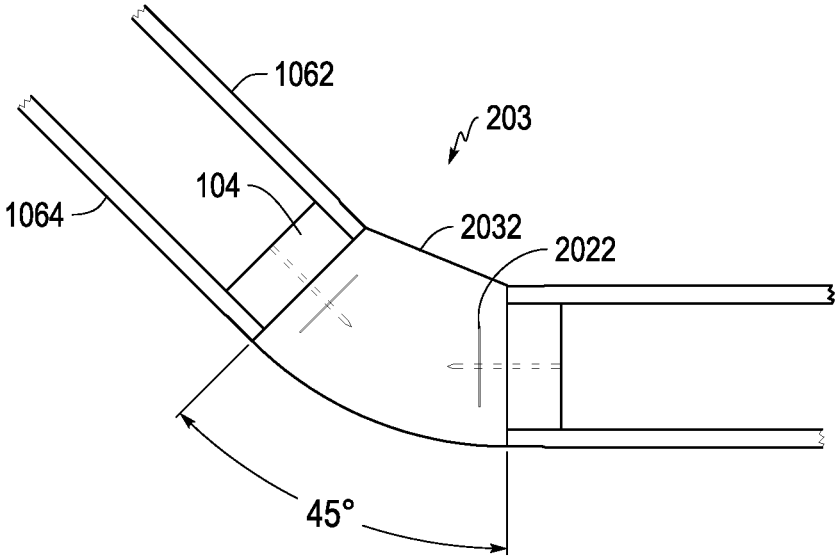
FIG. 20 is a plan view of an assembled wall structure including a corner construction element.

FIG. 20 is a plan view of an assembled wall structure including a corner construction element 203, which is designed for a non-90° corner, such as a 45° corner. As with the corner construction elements 202 described above, studs 104 are connected to the corner construction element 203 by passing fasteners 108 through the studs 104 and into fastener-engaging elements 2022. Although not depicted in FIG. 20, the corner construction element 203 may have a facing layer and/or wing portions as described above in connection with the corner construction elements 202. An additional facing layer may be provided on the inside surface 2032.

The inside surface 2032 of the corner construction element 203 in this embodiment is a single flat surface.

Figure 21:
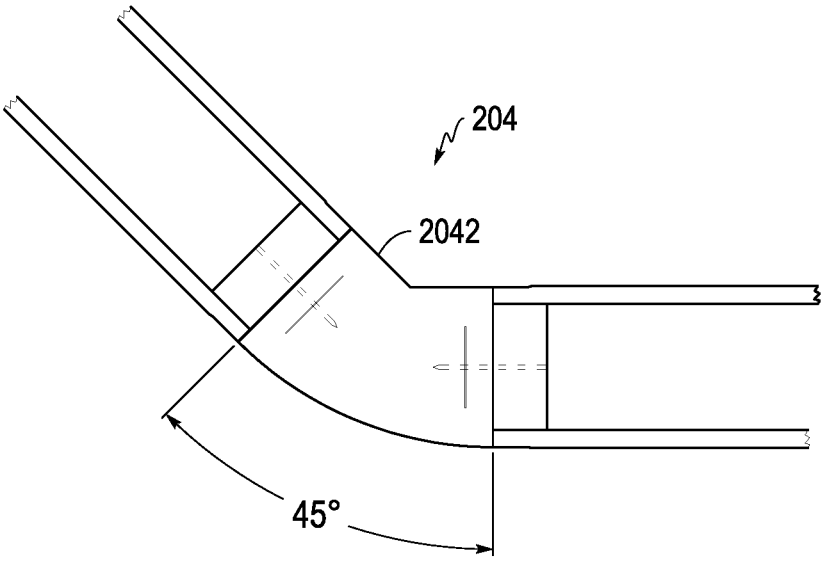
FIG. 21 is a plan view of an assembled wall structure including a corner construction element.

FIG. 21 is a plan view of an assembled wall structure including a corner construction element 204. The corner construction element 204 may be the same as the corner construction element 203 described above, except that the inside surface 2042 of the corner construction element 204 comprises two flat surfaces that meet to define an angled corner as shown. An additional facing layer may be provided on the inside surface 2042.

Figure 22:
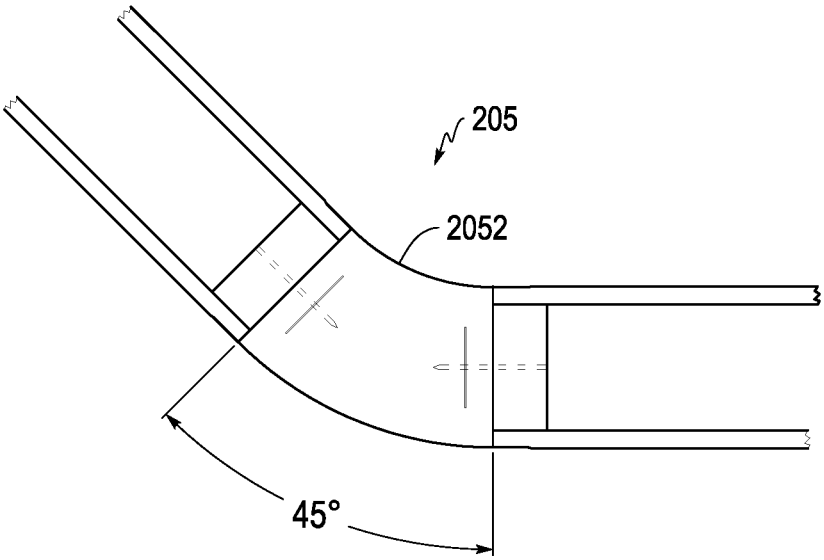
FIG. 22 is a plan view of an assembled wall structure including a corner construction element.

FIG. 22 is a plan view of an assembled wall structure including a corner construction element 205. The corner construction element 205 may be the same as the corner construction element 203 described above, except that the inside surface 2052 of the corner construction element 204 defines a curved surface. An additional facing layer may be provided on the inside surface 2052.

Figure 23:
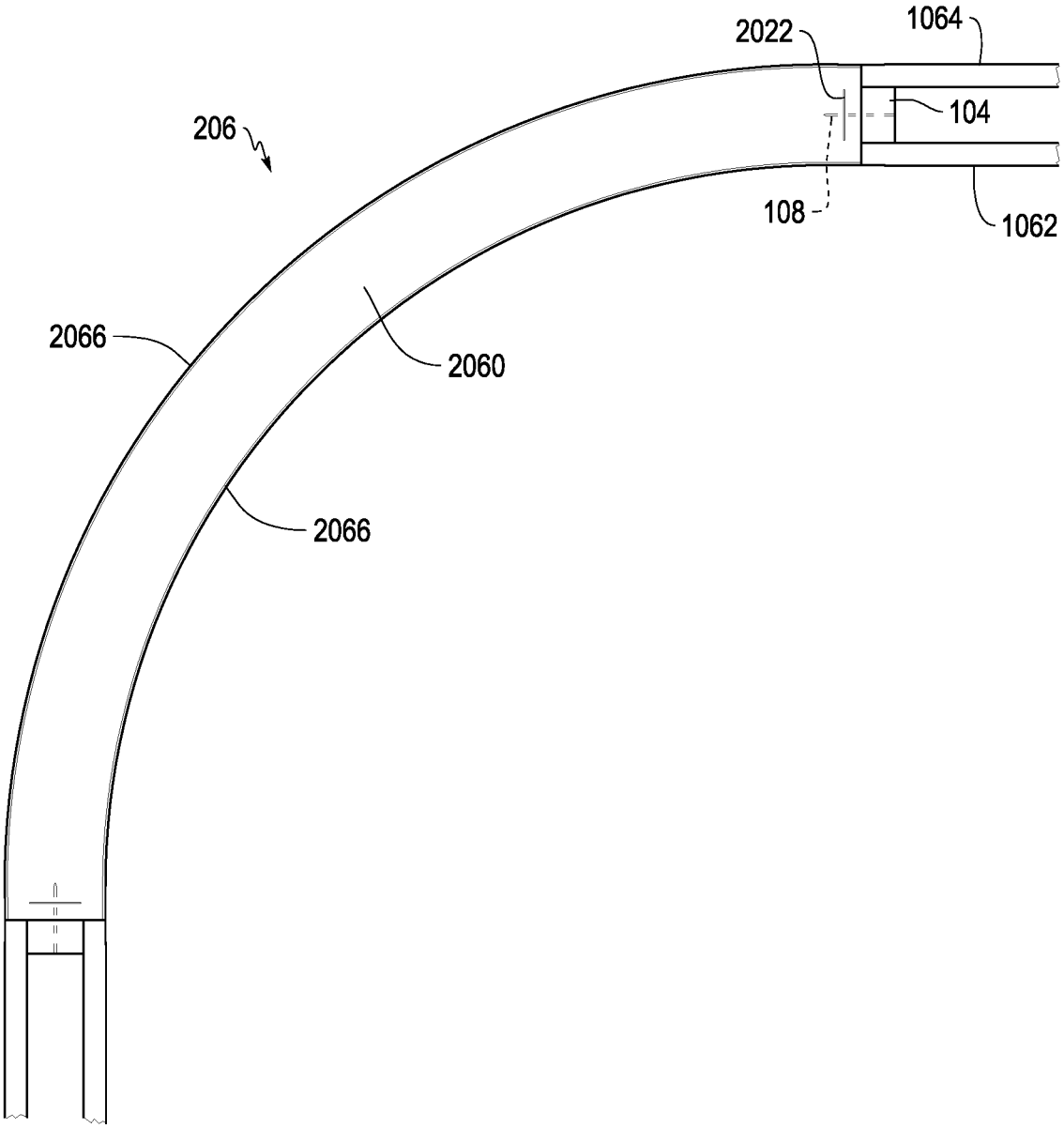
FIG. 23 is a plan view of an assembled wall structure including a corner construction element.

FIG. 23 is a plan view of an assembled wall structure including a corner construction element 206. The corner construction element 206 may have any desired radius, and may have facing layers 2066 on the inside and outside curved surfaces (corner-forming surfaces, which are not separately labeled in this embodiment) of the body 2060, which may be of foam material as described above. As with the corner construction elements 202 described above, studs 104 are connected to the corner construction element 206 by passing fasteners 108 through the studs 104 and into fastener-engaging elements 2022. Although not depicted in FIG. 23, the corner construction element 206 may have wing portions as described above in connection with the corner construction elements 202, extending from the outside curved surface and/or the inside curved surface, or the inside facing layer 2066 and/or the outside facing layer 2066.

Figure 24:
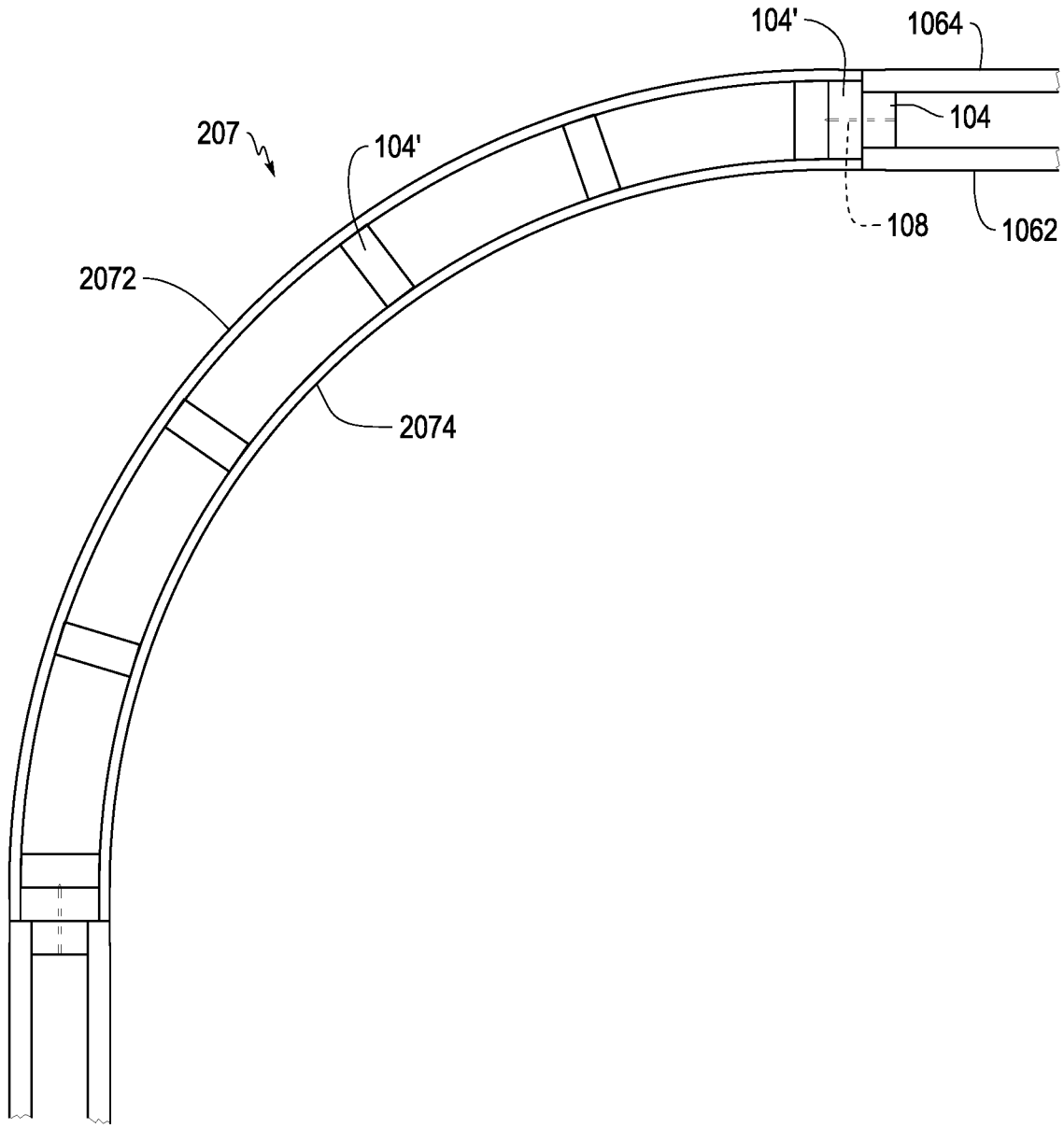
FIG. 24 is a plan view of an assembled wall structure including a corner construction element.

FIG. 24 is a plan view of an assembled wall structure including a corner construction element 207. The corner construction element 207 comprises studs 104', to which are attached curved wall elements 2072 and 2074. The end-most studs 104' are "fastener strips" in this embodiment. The curved wall elements 2072 and 2074 may be paper material, metal, wood, fiberglass, carbon-fiber material, plastic material such as PVC or vinyl, or a composite of any such materials. The curved wall elements 2072 and 2074 may be cut from a cylindrical tube of material, such as a cylindrical paperboard tube commonly known for forming concrete cylinders, such as Sonotube®. The curved wall elements 2072 and 2074 may be attached to the studs 104' by any suitable fasteners such as staples, nails, screws, tape or adhesive.

The studs 104' may be of wood, metal, fiberglass, carbon-fiber material, plastic material such as PVC or vinyl, or a composite of any such materials. As depicted, the studs 104' may have a different width, such as a greater width, than the studs 104 to compensate for the curved wall elements 2072 and 2074 typically being thinner than the wall panels 1062 and 1064.

Although the corner construction element 207 is shown with a relatively large radius, it may have a radius as small as about 2 inches. A typical maximum radius may be up to about several feet, or up to ten feet or even more. The radius may, for example, be any radius from 2 inches to ten feet, in increments of ⅛". Additionally, although the corner construction element 207 is shown with curvatures on both the inside and outside surfaces, the inside surface may be made square as with the corner construction elements 202 described above.

Although not depicted in FIG. 24, the corner construction element 207 may have wing portions as described above in connection with the corner construction elements 202, on the outside surface and/or the inside surface.

Figure 25:
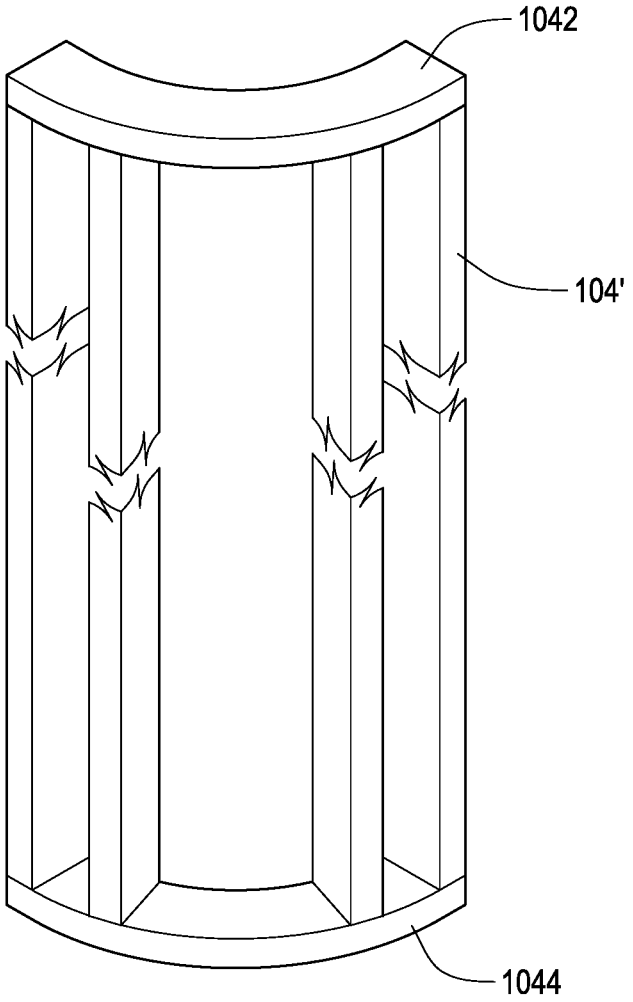
FIG. 25 is a perspective view of a corner construction element.

FIG. 25 is a perspective view of the corner construction element 207. A top plate 1042 and a bottom plate 1044 are attached to ends of the studs 104'. In this figure, the curved wall elements 2072 and 2074 are omitted so that the other elements may more easily be seen. Like the studs 104', the top plate 1042 and the bottom plate 1044 may be of wood, metal, fiberglass, carbon-fiber material, plastic material such as PVC or vinyl, or a composite of any such materials. In some embodiments, the top plate 1042 and the bottom plate 1044 may be cut from plywood, possibly being formed of two or more layers of plywood for greater strength and stability.

Although the corner construction element 207 is shown to match walls oriented at 90° relative to each other, it may be altered to match walls oriented at any other angle relative to each other.

The corner construction elements 102, 102', 202, 203, 204, 205, 206 and 207 and the end cap construction elements 102'', 102''', 202'' may exist as fully formed elements prior to attachment to wall structures such as stud wall frames.

Although the drawings depict wall structures having vertically extending studs, the construction elements may also be installed in other orientations. For example, a corner construction element according to any of the above-described embodiments may be installed where an overhead ceiling surface meets a vertical or slanted surface, such as in a stairwell. As another example, an end cap construction element according to any of the above-described embodiments may be installed on the overhead surface of a doorway or window opening.

While the invention has been described in conjunction with the specific embodiments described above, these embodiments should be viewed as illustrative and not limiting. Various changes, substitutes, improvements or the like are possible within the spirit and scope of the invention.

For example, although fastener-engaging elements 2022 are provided in some embodiments described above, in other embodiments the corner forming elements 202, 202" or 202'" may be attached to studs 104 by construction adhesive or the like.

What is claimed is:

1. A wall structure, comprising:

a plurality of framing studs;

a plurality of wall panels connected to the framing studs to define at least two separate wall surfaces; and a construction element, the construction element comprising:

a body including:

an outer corner-forming surface that is shaped to extend, in a cross-sectional view, between two separate first wall panels among the plurality of wall panels, such that ends of the outer corner-forming surface, as viewed in the cross-sectional view, substantially match respective corners of the first wall panels, the outer corner-forming surface being curved and having a constant radius over a majority of a length of the outer corner-forming surface;

stud attachment surfaces that are connected to the outer corner-forming surface; and an inner corner-forming surface that is connected to the stud attachment surfaces, and is shaped to extend, in a cross-sectional view, between two separate second wall panels among the plurality of wall panels, different from the first wall panels, such that ends of the inner corner-forming surface, as viewed in the cross-sectional view, substantially match respective corners of the second wall panels, the inner corner-forming surface being curved and having a constant radius over a majority of a length of the inner corner-forming surface, wherein the construction element exists as a fully formed element prior to attachment to the framing studs, and a radius of the outer corner-forming surface is at least 12 inches; and wherein the construction element forms a corner of an interior wall of a building, and the stud attachment surfaces are attached to separate ones of the studs.

2. A method of using a construction element to form a corner at which two building surfaces join, the surfaces being surfaces of wall panels attached to framing studs, the construction element comprising a body including:

an outer corner-forming surface that is shaped to extend, in a cross-sectional view, between two separate first wall panels, such that ends of the outer corner-forming surface, as viewed in the cross-sectional view, substantially match respective corners of the first wall panels, the outer corner-forming surface being curved and having a constant radius over a majority of a length of the outer corner-forming surface;

stud attachment surfaces that are connected to the outer corner-forming surface; and an inner corner-forming surface that is connected to the stud attachment surfaces, and are shaped to extend, in a cross-sectional view, between two separate second wall panels, different from the first wall panels, such that ends of the inner corner-forming surface, as viewed in the cross-sectional view, substantially match respective corners of the second wall panels, the inner corner-forming surface being curved and having a constant radius over a majority of a length of the inner corner-forming surface, wherein a radius of the outer corner-forming surface is at least 12 inches, the method comprising:

attaching each stud attachment surfaces of the construction element to an attachment surface of a respective one of the framing studs, the stud attachment surfaces being longer, as viewed in the cross-sectional view, than the attachment surfaces of the framing studs; and after attaching the construction element to the framing studs, attaching the first and second wall panels to the studs.

3. The method of claim 2, wherein the wall panels comprise drywall sheets.

4. The method of claim 2, wherein the radius of the outer corner-forming surface is at most 30 inches.

5. The method of claim 2, wherein the radius of the outer corner-forming surface is at most 10 feet.

6. The wall structure of claim 1, wherein the radius of the outer corner-forming surface is at most 30 inches.

7. The wall structure of claim 1, wherein the radius of the outer corner-forming surface is at most 10 feet.

* * * * *